US009266348B1

(12) United States Patent
LeFevre

(10) Patent No.: US 9,266,348 B1
(45) Date of Patent: Feb. 23, 2016

(54) ACTIVE DEVICE FOR SHIELDING MEDIA FROM A HEATER IN A PRINTER

(71) Applicant: Xerox Corporation, Norwalk, CT (US)

(72) Inventor: Jason Matthew LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/546,242

(22) Filed: Nov. 18, 2014

(51) Int. Cl.

| | |
|---|---|
| ***B41M 7/00*** | (2006.01) |
| ***G03G 15/20*** | (2006.01) |
| ***B41J 2/335*** | (2006.01) |

(52) U.S. Cl.
CPC ..... *B41J 2/335* (2013.01); *B41M 7/009* (2013.01); *G03G 15/2017* (2013.01)

(58) Field of Classification Search
USPC ..... 347/101, 102, 212
See application file for complete search history.

(56) References Cited

U.S. PATENT DOCUMENTS

| | | | | |
|---|---|---|---|---|
| 4,019,054 | A | 4/1977 | Saito et al. | |
| 5,068,684 | A | 11/1991 | Abe et al. | |
| 5,081,502 | A | 1/1992 | Mitsuya et al. | |
| 5,506,666 | A | 4/1996 | Masuda et al. | |
| 5,887,238 | A | 3/1999 | Matsuzoe et al. | |
| 6,085,060 | A | 7/2000 | Goldmann et al. | |
| 6,674,990 | B2 | 1/2004 | Rohde et al. | |
| 2003/0011669 | A1 * | 1/2003 | Tsuboi et al. | 347/102 |
| 2007/0230984 | A1 * | 10/2007 | Noguchi | 399/69 |
| 2009/0021550 | A1 * | 1/2009 | Leighton et al. | 347/17 |
| 2010/0045720 | A1 * | 2/2010 | Williams et al. | 347/14 |
| 2013/0293648 | A1 * | 11/2013 | Sheflin et al. | 347/102 |

FOREIGN PATENT DOCUMENTS

| | | | | |
|---|---|---|---|---|
| JP | 63-262671 | * | 10/1988 | 399/329 |
| JP | 01-206381 | * | 8/1989 | 399/336 |
| JP | 02-140781 | * | 5/1990 | 399/329 |
| JP | 03-078079 | * | 12/1991 | 399/329 |
| JP | 06-236120 | * | 8/1994 | G03G 15/20 |
| JP | 06-332143 | * | 12/1994 | G03D 13/00 |
| JP | 09-212016 | * | 8/1997 | G03G 15/20 |

* cited by examiner

*Primary Examiner* — Huan Tran
(74) *Attorney, Agent, or Firm* — Maginot Moore & Beck LLP

(57) ABSTRACT

A printer includes a heating element and an active media shielding device configured to prevent print media from being overheated by the heating element. The shielding device includes an endless belt interposed between the print media and the heating element and configured to rotate to dissipate heat. The endless belt is arranged on, and tensioned by, two pulleys such that a portion of the endless belt is arranged nearest to the heating element and a portion of the endless belt is arranged nearest to the print media. The shielding device also includes a cleaning device configured to remove portions of print media from the endless belt.

15 Claims, 10 Drawing Sheets

ACTIVE DEVICE FOR SHIELDING MEDIA FROM A HEATER IN A PRINTER

TECHNICAL FIELD

This disclosure relates generally to printers and, specifically to printers that include media heaters.

BACKGROUND

The word "printer" as used herein encompasses any apparatus, such as a digital copier, book marking machine, facsimile machine, multi-function machine, etc., that produces an image with a colorant on recording media for any purpose. Continuous feed printers produce images on a continuous web of recording media which passes by the marking engine. Continuous feed printers also include heaters to warm the web of recording media and/or the ink which produces the images at various stages during the printing process.

By way of example, FIG. 10 depicts a prior art continuous web inkjet printer 800. In the embodiment shown, the printer 800 implements a process for printing onto a continuous media web. The continuous web printer system 800 includes twenty print modules 880-899, a controller 828, a memory 829, guide rollers 816, pre-heater roller 818, apex roller 820, leveler roller 822, tension sensors 852A-852B, 854A-854B, and 856A-856B, and velocity sensors, such as encoders 860, 862, and 864. The print modules 880-899 are positioned sequentially along a media path P and form a print zone from a first print module 880 to a last print module 899 for forming images on a print medium 814 as the print medium 814 travels past the print modules. Each print module 880-883 provides a magenta ink. Each print module 884-887 provides cyan ink. Each print module 888-891 provides yellow ink. Each print module 892-895 provides black ink. Each print module 896-899 provides a clear ink as a finish coat. In all other respects, the print modules 880-899 are substantially identical. The media web travels through the media path P guided by rollers 816, pre-heater roller 818, apex roller 820, and leveler roller 822. A heated plate 819 is provided along the path. The pre-heater roller 818, apex roller 820, and leveler roller 822 are each examples of a capstan roller that engages the media web 814 on a portion of its surface. A brush cleaner 824 and a contact roller 826 are located at one end 834 of the media path P. A heater 830 and a spreader 832 are located at the opposite end 836 of the media path P.

Operation and control of the various subsystems, components and functions of printing system 800 are performed with the aid of a controller 828 and memory 829. In particular, controller 828 monitors the velocity and tension of the media web 814 and determines timing of ink drop ejection from the print modules 880-899. The controller 828 can be implemented with general or specialized programmable processors that execute programmed instructions. Controller 828 is operatively connected to memory 829 to enable the controller 828 to read instructions and to read and write data required to perform the programmed functions in memory 829. Memory 829 can also hold one or more values that identify tension levels for operating the printing system with at least one type of print medium used for the media web 814. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

As illustrated in FIG. 10, the media web 814 passes various heating elements such as, for example, the heated plate 819 and the heater 830, each of which applies heat to the media web to facilitate subsequent processing. Other embodiments of continuous web printers may include other heating elements positioned in varying locations along the media path P. At each location along the continuous web printer system 800 where a heating element applies heat to the media web 814, a risk exists that the media web can be weakened by the heat and break. One previous attempt to prevent printer heating elements from degrading media includes placing a metal screen between the heating element and the media. The screen absorbs heat, however, and if the media contacts the metal screen, the screen can overheat the media. Accordingly, in printers that include heating elements positioned along a media path, reliably preventing the heating element from degrading the media web 814 is a desirable goal.

SUMMARY

A printer having an active media shielding device has been developed to prevent printer heating elements from degrading print media. The printer includes a media transport configured to move media along a path through the printer in a process direction. The printer also includes a heater positioned along the path of the media through the printer to heat the media as the media moves by the heater. The printer further includes an endless belt interposed between the heater and the media moving along the path, and an actuator operatively connected to the endless belt to rotate the endless belt and dissipate heat in the endless belt.

An apparatus for mounting within a printer has been developed to prevent printer heating elements from degrading print media. The apparatus includes a heater positioned along a path of the media through the printer to heat the media as the media moves by the heater. The apparatus also includes an endless belt of mesh entrained about a first pulley and a second pulley. The endless belt of mesh is configured to be interposed between a heater and a media path in the printer. The apparatus further includes an actuator operatively connected to the first pulley to rotate the endless belt and dissipate heat absorbed by the endless belt from the heater before a portion of the endless belt moves parallel to a process direction along the media path.

BRIEF DESCRIPTION OF THE DRAWINGS

The foregoing aspects and other features of a printer having an active media shielding device are explained in the following description, taken in connection with the accompanying drawings.

DETAILED DESCRIPTION

Figure 1:
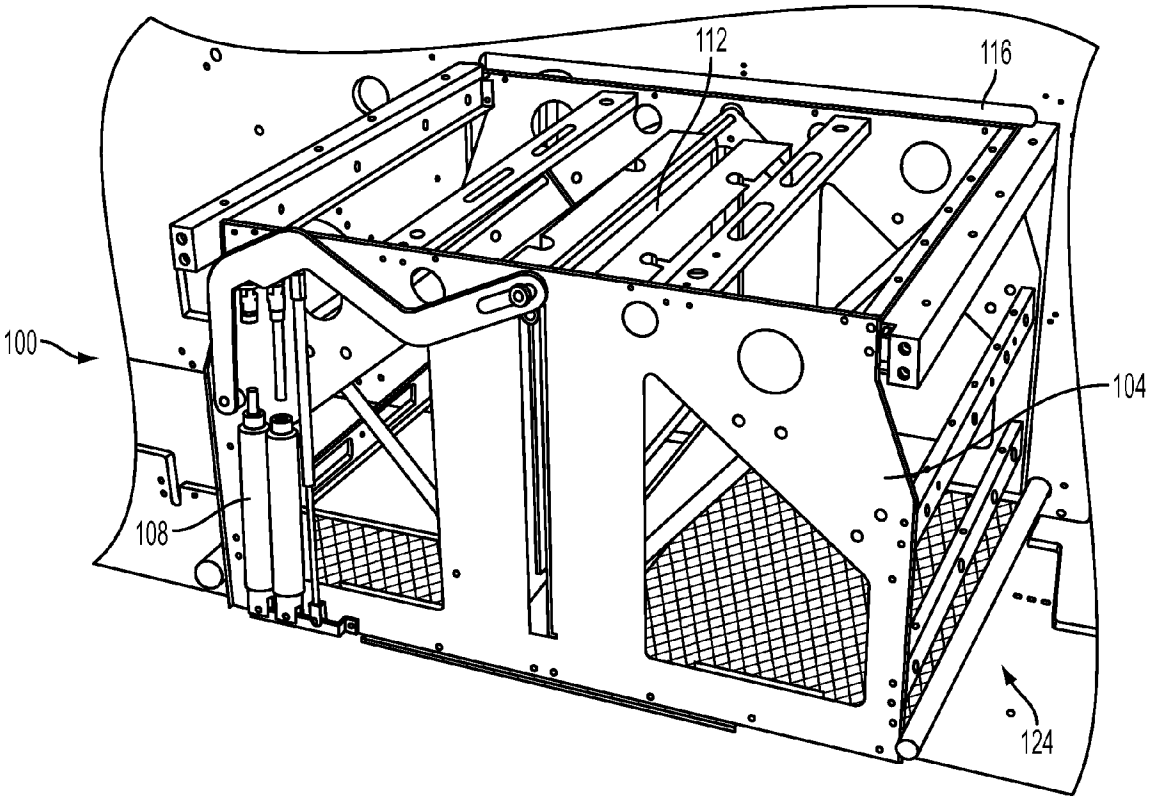
FIG. 1 is a front perspective view of a heater system for use within a printer.

The description below and the accompanying figures provide a general understanding of the environment for the printer having a heating system and an active media shielding device disclosed herein as well as the details for the device and assembly. In the drawings, like reference numerals are used throughout to designate like elements.

Figure 10:
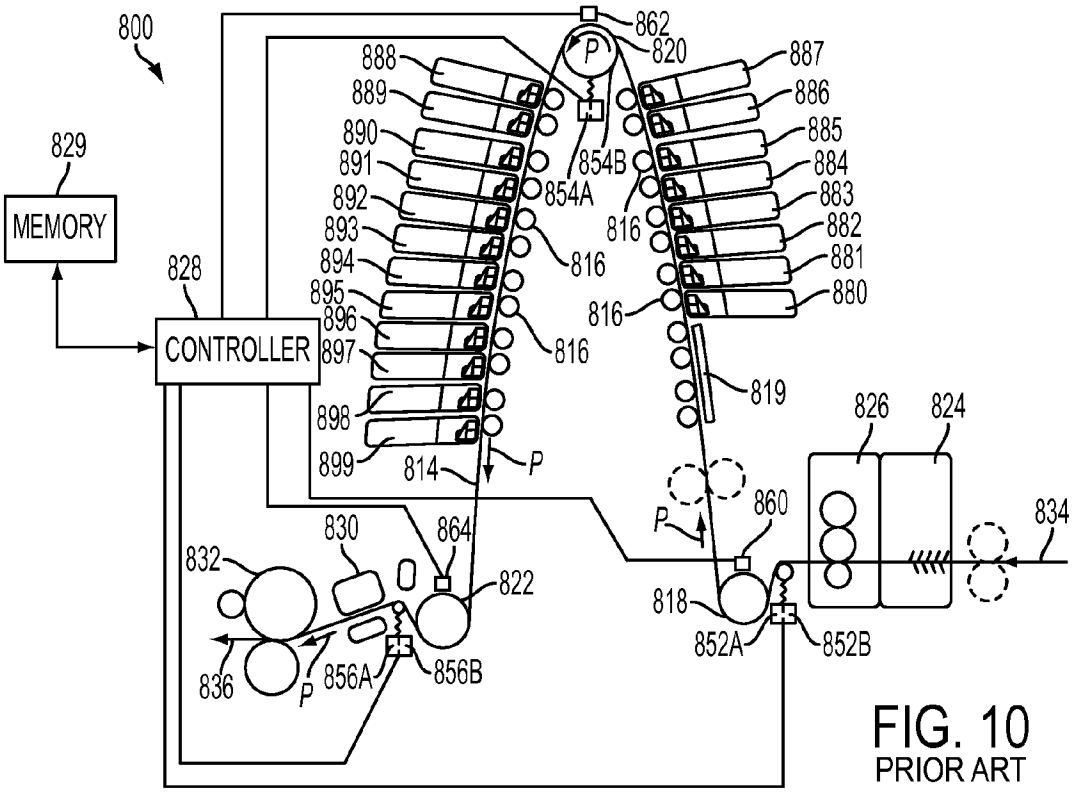
FIG. 10 PRIOR ART
FIG. 10 is a schematic drawing of a prior art continuous web inkjet printing system.

FIG. 1 is a front perspective view of a heater system 100 for use within a printer, such as printer 800 shown in FIG. 10. The heater system 100 includes a support structure 104, a pneumatic system 108, and a pair of heater panels 112 operatively coupled to the pneumatic system 108. The pneumatic system 108 and the heater panels 112 are configured with the support structure 104 so actuation of the pneumatic system 108 moves the heater panels 112 from an idle position (shown in FIG. 1) to an in-use position (shown in FIG. 2). The support structure 104 can be made of, for example, sheet metal, or another durable material having high heat tolerance. Thermal barriers 116 are mounted along the sides of the support structure 104, pneumatic system 108, and radiant heater panels 112 to prevent heat generated by the heater panels 112 from damaging other systems within the printer. By way of example, only one barrier 116 mounted on one side is shown here. Additionally, an active device 124 for shielding media from the radiant heater panels is provided between the heater 100 and a media path.

The heater system 100 shown in FIG. 1 is a radiant heater subsystem configured to generate thermal energy sufficient to heat print media 120 (shown in FIG. 2) prior to the print media entering a spreader (such as spreader 832 shown in FIG. 10), which spreads and fixes ink to the print media 120. More specifically, in this embodiment, the heater panels 112 are long-wave infrared heater panels operated to have surface temperatures of, for example, 300 to 400 degrees Celsius. The reader should understand, however, that the active device is applicable to different types of heater systems and different temperature ranges.

Figure 2:
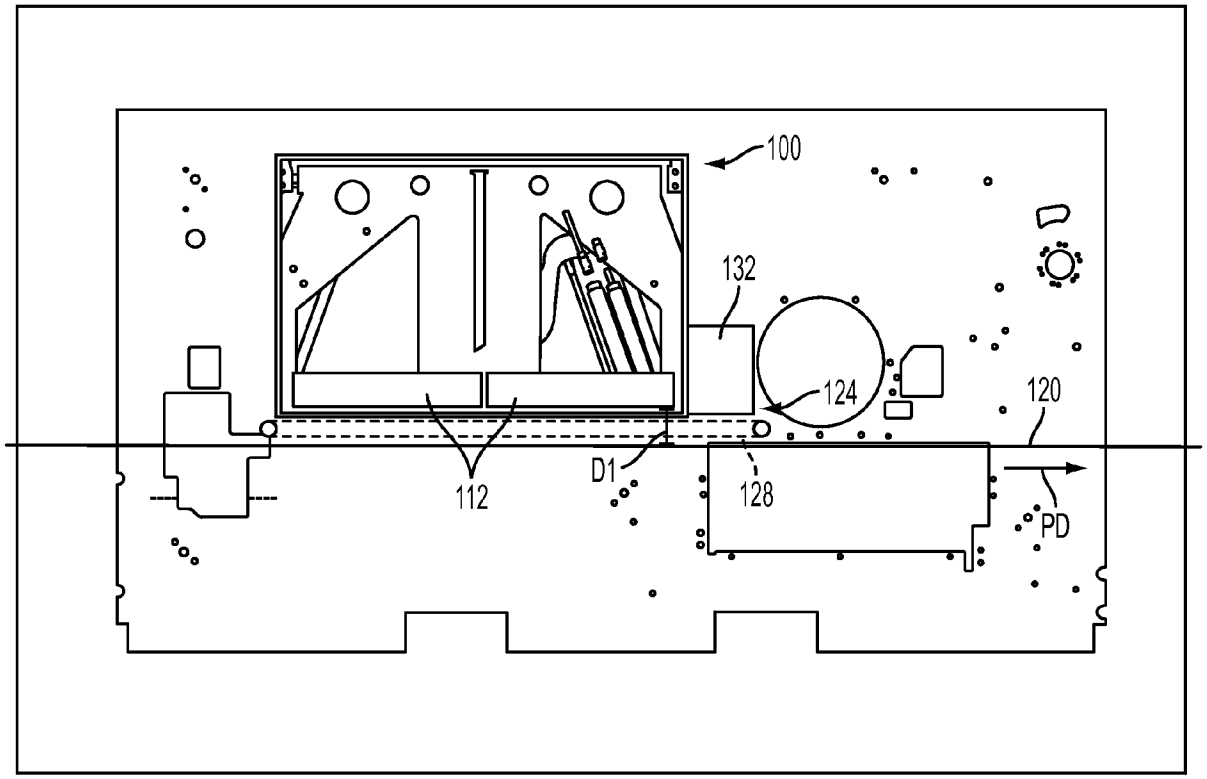
FIG. 2 is a side cross-sectional view of the heater system of FIG. 1 and an active media shielding device.

As shown in FIG. 2, when the heater panels 112 are positioned parallel to the print media 120, the media is exposed to a maximum amount of heat. In this embodiment, the print media 120 is a continuous web of print media driven in a process direction PD. The active devices described in this document, however, is also applicable in heaters that heat media not in the form of a continuous web. As the print media 120 passes the radiant heater panels 112, the print media 120 and the radiant heater panels 112 are separated by a distance D1 of, for example, less than 1 inch. If the movement of the print media 120 is suspended in front of the heater panels 112 for a longer period of time than is required for effective spreading of the ink with the spreader, the print media 120 may be degraded and break. To address this issue, the active media shielding device 124 is configured to attenuate the exposure of the print media 120 to the heater panels 112 for such extended periods of time. As shown in FIG. 2, the shielding device 124 includes an endless belt 128 and a cleaning device 132.

Figure 3:
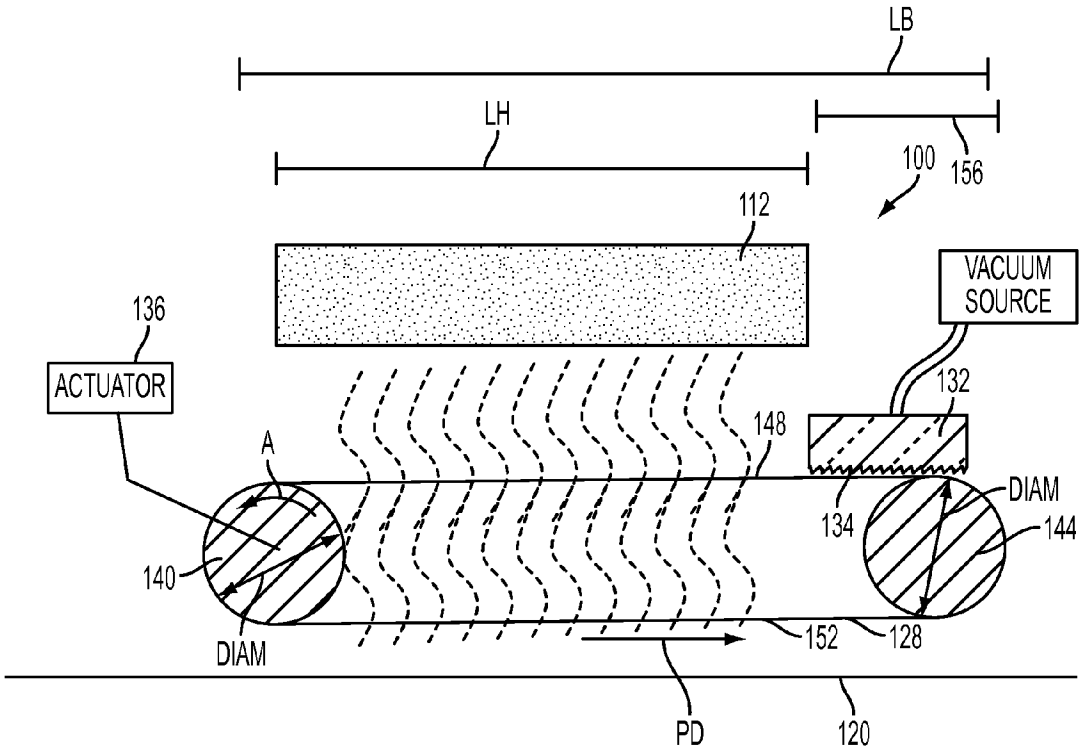
FIG. 3 is a side schematic view of a portion of the heater system and the active media shielding device of FIG. 2.

More specifically, as shown in FIG. 3, the endless belt 128 is interposed between the print media 120 and the heater panels 112 and is arranged so as to be substantially parallel with the print media 120 and the heater panels 112 when the heater panels 112 are parallel to the media as shown in FIG. 2. The endless belt 128 is preferably made of a mesh to provide surface area on the endless belt 128 and thereby enable the endless belt 128 to be cooled by ambient air. The mesh is made of a heat tolerant material such that it can withstand the radiant heat generated by the heater panels 112. Further, the mesh is made of a heat resistant material such that the temperature of the endless belt 128 remains less than that of the heater panels 112. In at least one embodiment, the mesh is substantially made of, for example, at least one of stainless steel, fiberglass, and a thermally insulating material, such as INCONEL®. The mesh of the endless belt 128 is configured with a diameter and frequency of strands of the material sufficiently small such that energy emitted by the heater panels 112 is not significantly altered prior to reaching the print media 120.

The endless belt 128 is suspended on a driven pulley 140 and an idler pulley 144 such that the endless belt 128 is tensioned by the driven pulley 140 and idler pulley 144. The pulley 140 is rotationally driven by the actuator 136 such that when the actuator 136 rotates the driven pulley 140, the endless belt 128 rotates around the driven pulley 140 and the idler pulley 144. Rotating the driven pulley 140 with the actuator 136 rotates the endless belt 128 and the idler pulley 144. The actuator 136 rotationally drives the driven pulley 140 at a speed sufficiently fast such that any portions of the print media 120 that contact the endless belt 128 are carried out of the area in front of the heater panels 112 prior to the media being degraded. For example, the actuator 136 can drive the driven pulley 140 at a speed of approximately 180 mm/s or faster.

The driven pulley 140 and the idler pulley 144 each have a diameter DIAM such that the when the endless belt 128 is positioned on the pulleys 140, 144, portion 148 of the endless belt 128 is closer to the heater panels 112 than portion 152 of the endless belt 128, which is positioned closer to the print media 120. The separation of portion 148 and portion 152 by the diameter DIAM of the pulleys 140, 144 enables ambient air to pass through the belt and dissipate heat from the endless belt 128. The driven pulley 140 is operated by the actuator 136 to rotate in a direction shown by arrow A such that portion 148 travels between the pulleys 140, 144 in a direction opposite to the process direction PD and portion 152 of the endless belt 128 travels between the pulleys 140, 144 in the process direction PD. This arrangement is advantageous because if any portion of the print media 120 comes into contact with portion 152 of the endless belt 128, the print media 120 and the media portion 152 are traveling in the same direction. This common direction of movement prevents the print media 120 from becoming stuck or tangled in the endless belt 128 while being exposed to the panels 112.

The cleaning device 132 is positioned to contact the endless belt 128 without being interposed between the heater panels 112 and the print media 120. In the embodiment shown in FIG. 3, the cleaning device 132 is arranged above the endless belt 128, adjacent to the heater system 100, and above the idler pulley 144. More specifically, the endless belt 128 has a length LB which is longer than a length LH of the heater system 100. This length difference provides a space 156 in which to arrange the cleaning device 132 to enable the cleaning device 132 to contact the endless belt 128 without being interposed between the heater panels 112 and the print media 120. The length LB of the endless belt 128 can be, for example, 450 mm, and the length LH of the heater system 100 can be, for example 350 mm, such that the space 156 for the cleaning device 132 is approximately 100 mm. While this arrangement is an example of one advantageous embodiment, other arrangements and locations for the cleaning device 132 can be used to achieve these goals.

The cleaning device 132 is further arranged so as to contact the endless belt 128 after the endless belt 128 passes nearest to the print media 120 and before the endless belt 128 passes by the heater panels 112. In other words, the cleaning device 132 is arranged between portion 152 and portion 148 of the endless belt 128. This positioning enables the cleaning device 132 to clean any portions or particles of the print media 120 from the endless belt 128 before such media debris is brought into the vicinity of the heater panels 112.

In at least one embodiment, the cleaning device 132 includes a vacuum source and stiff bristles 134. The stiff bristles 134 are located such that the endless belt 128 contacts the stiff bristles as a vacuum is applied to an opening in the cleaning device 132 in which the bristles 134 are mounted. Accordingly, any media debris on the endless belt 128 is loosened from the endless belt 128 by the stiff bristles and vacuumed from the endless belt 128 by the vacuum source before that portion of the endless belt 128 passes by the heater panels 112.

Figure 4:
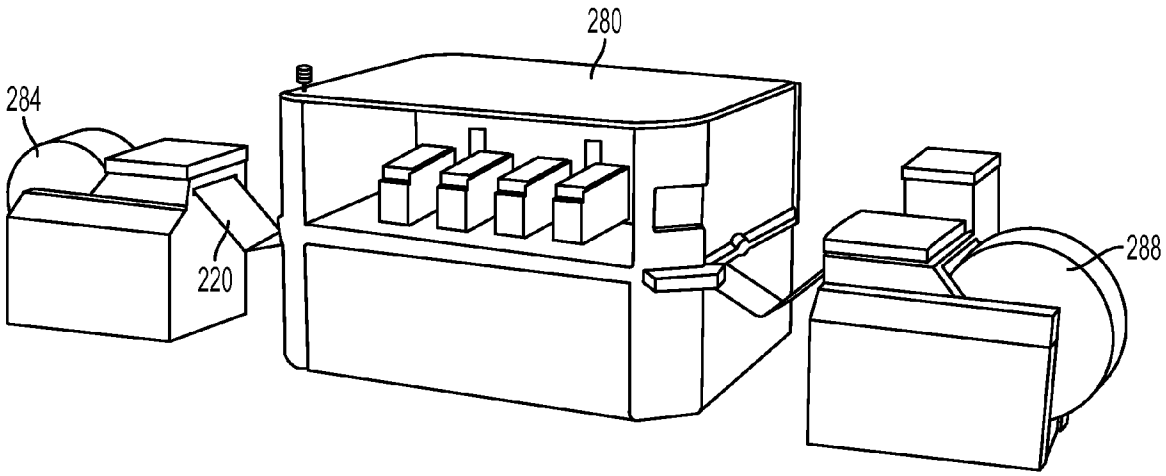
FIG. 4 is a side perspective view of a printer which can include a heater system substantially similar to that shown in FIG. 1 and an active media shielding device substantially similar to that shown in FIG. 3.
Figure 5:
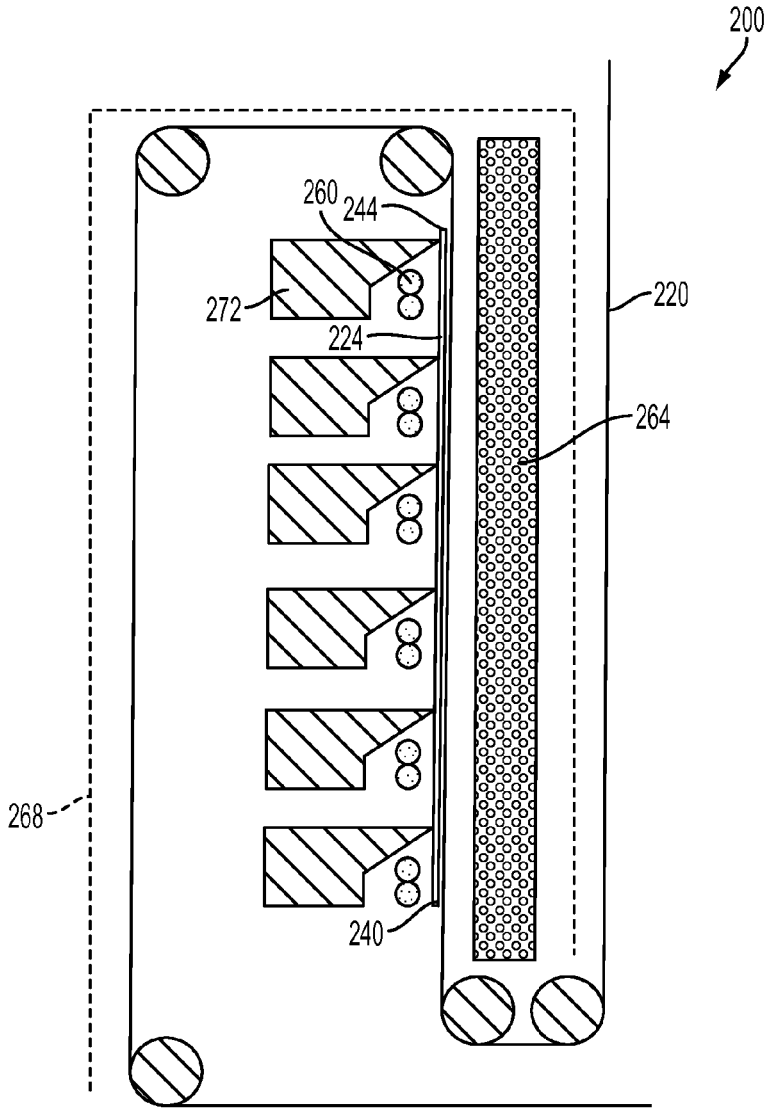
FIG. 5 is a front schematic view of a heater system in the printer of FIG. 4.

FIG. 4 depicts another type of printer 280 in which an active media shielding device 224 (shown in FIG. 5), substantially similar to the active media shielding device 124, can be used. As shown in FIG. 4, a continuous web of print media 220 is unwound from a first roll of unprinted media 284, passes through the printer 280, and is wound onto a second roll of printed media 288. FIG. 5 depicts a schematic view of a heater system 200 positioned within the printer 208 shown in FIG. 4. The heater system 200 is a dryer used for drying printed images on print media 220 using a plurality of infrared lamps 260, a back reflector 264, and a dryer enclosure 268. The dryer 200 includes six infrared lamps 260, each of which is, for example, a twin tube, carbon arc emitting lamp having a medium wavelength of approximately 2 micrometers, emitting 4000 watts, and having a surface temperature that reaches 1500 to 2000 degrees Celsius. Each infrared lamp 260 has a respective slot dryer plenum 272 coupled thereto. A media shielding device 224 is interposed between the infrared lamps 260 and the print media 220.

Figure 6:
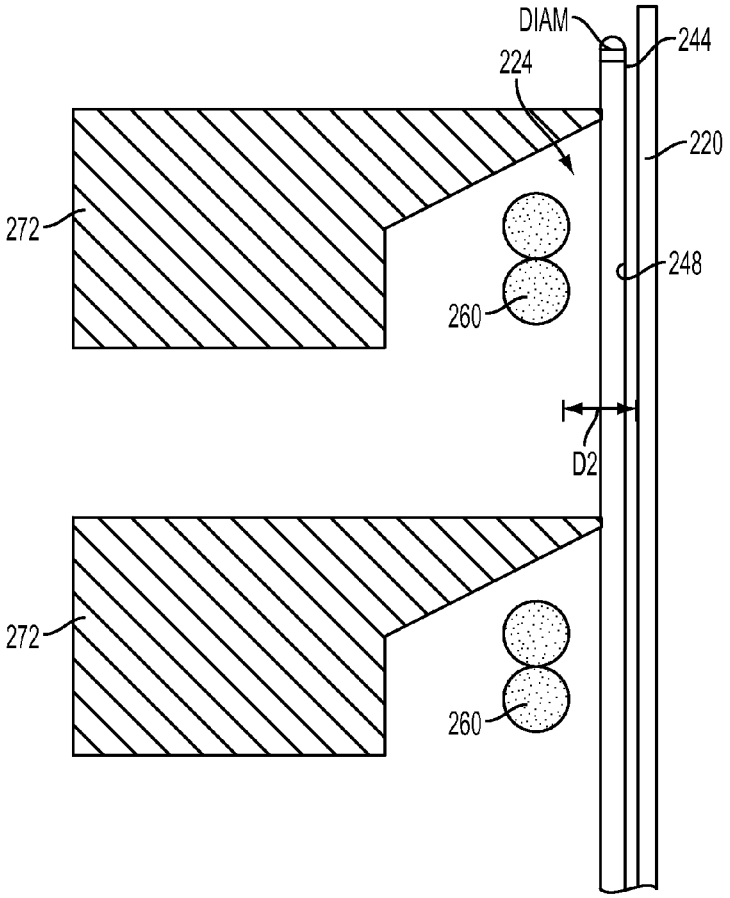
FIG. 6 is a front schematic view of a portion of the heater system of FIG. 5 with the active media shielding device.

FIG. 6 depicts a larger view of two of the infrared lamps 260 and a portion of the media shielding device 224 in more detail. The shielding device 224 is substantially similar to, but is smaller than, the shielding device 124 described above with reference to FIGS. 1-4 because the distance D2 between the infrared lamps 260 and the print media 220 is approximately 35 mm. Each of the driven pulley 240 (shown in FIG. 5) and the idler pulley 244 therefore, has a diameter DIAM which is smaller than 35 mm. Accordingly, the endless belt 248 is arranged within the distance D2 between the infrared lamps 260 and the print media 220 to prevent the print media 220 from being degraded by the heat produced by the dryer 200.

Returning to FIG. 5, each infrared lamp 260 produces heat directed toward a front side of the print media 220 as the print media passes through the dryer 200. The heat is reflected onto a back side of the print media 220 by the back reflector 264. The infrared lamps 260 and the back reflector 264 are enclosed within the dryer enclosure 268 which maintains the hot air temperature within the dryer 200 and circulates the hot air around the print media 220. The media shielding device 224 is interposed between the infrared lamps 260 and the print media 220.

Figure 7:
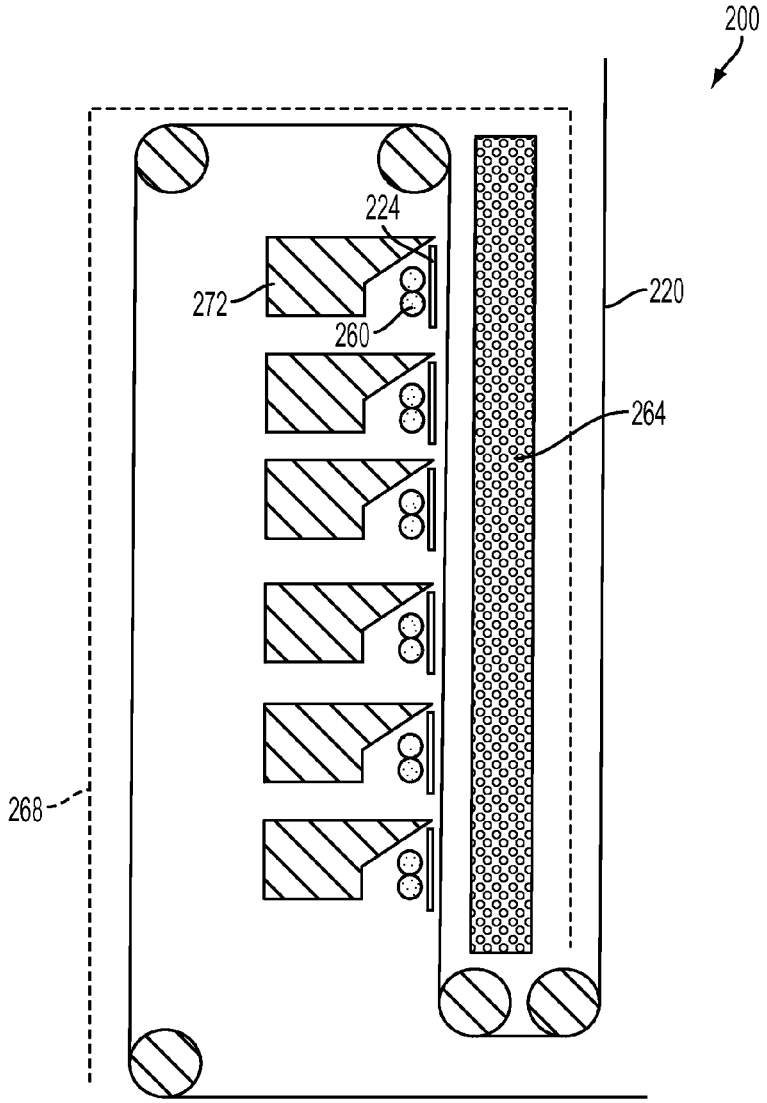
FIG. 7 is a front schematic view of another embodiment of a heater system in the printer of FIG. 4.
Figure 8:
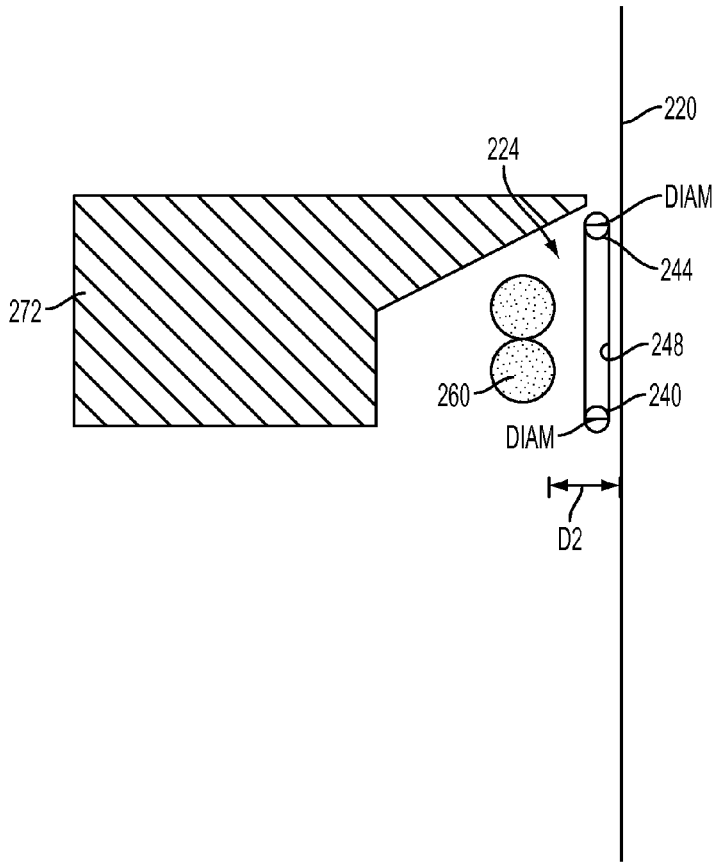
FIG. 8 is a front schematic view of a portion of the heater system of FIG. 7 with the active media shielding device.

In an alternative embodiment shown in FIG. 7, each of the infrared lamps 260' has a respective, individual media shielding device 224' interposed between the infrared lamp 260' and the print media 220'. Accordingly, in this alternative embodiment, the dryer 200' includes six infrared lamps 260' and six respective media shielding devices 224'. One of the infrared lamps 260' and respective media shielding devices 224' is depicted in FIG. 8 in more detail. As shown, the diameter DIAM' of each of the driven pulley 240' and idler pulley 244' is smaller than the distance D2' between the infrared lamp 260' and the print media 220' to enable the endless belt 248' to be arranged between the infrared lamp 260' and the print media 220' and thereby prevent the print media 220' from being degraded by the heat produced by the dryer 200'.

Figure 9:
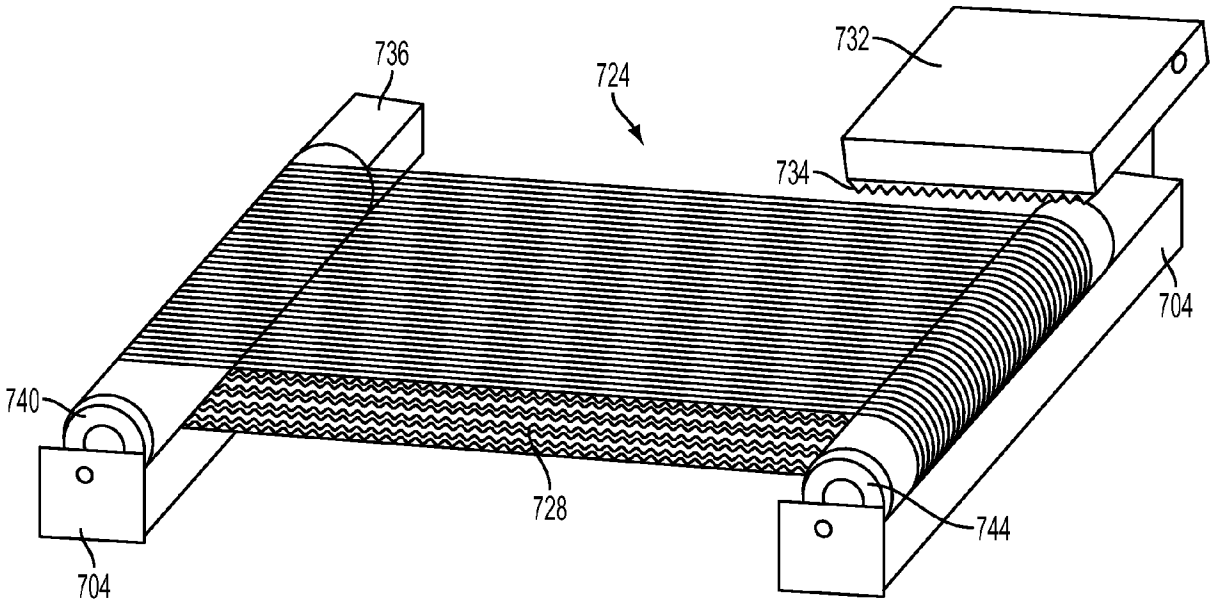
FIG. 9 is a side perspective view of the active media shielding device in the printer of FIG. 4.

The embodiments of the media shielding devices 124, 224, and 224' have been shown as being mounted within a printer. Additionally, support members 704 can be provided, as shown in FIG. 9, to enable an actuator 736, rollers or pulleys 740, 744, and a cleaning device 732 of a media shielding device 724 to be mounted to the support members 704 and form a modular apparatus 700. This apparatus 700 can be retrofitted in existing printers to interpose the endless belt 728 of the media shielding apparatus 724 between a heater in the printer and a media path within the printer.

It will be appreciated that some or all of the above-disclosed features and other features and functions or alternatives thereof, may be desirably combined into many other different systems, apparatus, devices, or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a media transport configured to move media along a path through the printer in a process direction;

a heater positioned along the path of the media through the printer to heat the media as the media moves by the heater;

an endless belt interposed between the heater and the media moving along the path;

an actuator operatively connected to the endless belt to rotate the endless belt and dissipate heat in the endless belt; and a cleaning device configured to clean the endless belt.

2. The printer of claim 1 wherein the heater is a radiant heater.

3. The printer of claim 1 wherein the cleaning device is positioned to contact a portion of the endless belt without being interposed between the heater and the media moving along the path.

4. The printer of claim 1 wherein the cleaning device includes a vacuum source.

5. The printer of claim 1, the cleaning device further comprising:

bristles configured to engage a portion of the endless belt to disengage debris from the endless belt and enable the vacuum source to remove the disengaged debris from the cleaning device.

6. The printer of claim 1, the cleaning device being positioned to clean a portion of the endless belt after that portion has moved away from the media and before that portion moves in front of the heater.

7. The printer of claim 1, wherein the actuator rotates a side of the endless belt closest to the media in the process direction.

8. The printer of claim 1, the endless belt further comprising:

a mesh material.

9. The printer of claim 8, wherein the endless belt essentially consists of one of stainless steel, fiberglass, and a thermally insulated material.

10. The printer of claim 1 further comprising:

a first pulley; and a second pulley, the endless belt being entrained about the first and the second pulleys and the first pulley being configured to be driven by the actuator to rotate the endless belt about the first and the second pulleys.

11. An apparatus for mounting within a printer comprising:

a heater positioned along a path of the media through the printer to heat the media as the media moves by the heater;

an endless belt of mesh entrained about a first pulley and a second pulley, the endless belt of mesh being configured to be interposed between a heater and a media path in the printer;

an actuator operatively connected to the first pulley to rotate the endless belt and dissipate heat absorbed by the endless belt from the heater before a portion of the endless belt moves parallel to a process direction along the media path; and a cleaning device configured to clean the endless belt.

12. The apparatus of claim 11 wherein the cleaning device is positioned to contact a portion of the endless belt without being interposed between the heater and the media moving along the path.

13. The apparatus of claim 11 wherein the cleaning device includes a vacuum source.

14. The apparatus of claim 11, the cleaning device further comprising:

bristles configured to engage a portion of the endless belt to disengage debris from the endless belt and enable the vacuum source to remove the disengaged debris from the cleaning device.

15. The apparatus of claim 11 wherein the mesh of the endless belt essentially consists of one of stainless steel, fiberglass, and a thermally insulated material.

* * * * *